US009207570B2

(12) United States Patent
Naruse et al.

(10) Patent No.: US 9,207,570 B2
(45) Date of Patent: Dec. 8, 2015

(54) DEVELOPING DEVICE, IMAGE FORMING APPARATUS AND TONER CONCENTRATION DETECTING METHOD USING LC OSCILLATOR CIRCUIT

(71) Applicant: KYOCERA Document Solutions Inc., Osaka (JP)

(72) Inventors: Kentaro Naruse, Osaka (JP); Rie Tezuka, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/489,785

(22) Filed: Sep. 18, 2014

(65) Prior Publication Data

US 2015/0086229 A1 Mar. 26, 2015

(30) Foreign Application Priority Data

Sep. 20, 2013 (JP) ..... 2013-196046
Sep. 20, 2013 (JP) ..... 2013-196047

(51) Int. Cl.
*G03G 15/08* (2006.01)

(52) U.S. Cl.
CPC ..... *G03G 15/0825* (2013.01); *G03G 15/0865* (2013.01)

(58) Field of Classification Search
CPC ..... G03G 15/0825; G03G 15/0829
USPC ..... 399/30
See application file for complete search history.

(56) References Cited

U.S. PATENT DOCUMENTS

| | | | | |
|---|---|---|---|---|
| 3,572,551 | A * | 3/1971 | Gillespie et al. | 399/30 |
| 4,270,487 | A * | 6/1981 | Terashima et al. | 399/63 |
| 4,987,453 | A * | 1/1991 | Laukaitis | G03G 15/0851 355/77 |
| 5,298,960 | A * | 3/1994 | Fukuchi et al. | 399/29 |
| 6,275,665 | B1 * | 8/2001 | Miyashiro | G03G 15/086 399/27 |
| 2002/0154918 | A1 * | 10/2002 | Sawayama | G03G 15/0853 399/63 |
| 2007/0086797 | A1 * | 4/2007 | Watanabe | 399/27 |
| 2007/0188245 | A1 * | 8/2007 | Kraemer | H03L 7/087 331/16 |
| 2009/0315546 | A1 * | 12/2009 | Woodard et al. | 324/239 |
| 2010/0290795 | A1 * | 11/2010 | Seki et al. | 399/30 |
| 2012/0106986 | A1 * | 5/2012 | Saito et al. | 399/12 |
| 2014/0312886 | A1 * | 10/2014 | Hirota et al. | 324/228 |

FOREIGN PATENT DOCUMENTS

| | | |
|---|---|---|
| JP | 10-062390 | 3/1998 |
| JP | H10-62390 | 3/1998 |
| JP | 2001-194960 | 7/2001 |

* cited by examiner

*Primary Examiner* — Billy Lactaoen
*Assistant Examiner* — Arlene Heredia Ocasio
(74) *Attorney, Agent, or Firm* — Knobbe, Martens, Olson & Bear LLP

(57) ABSTRACT

A developing device includes multiple developing units, and multiple toner concentration sensors. The multiple developing units contain respective developers. The multiple toner concentration sensors have respective LC oscillator circuits and are disposed at the respective multiple developing units. A capacitor constituting the LC oscillator circuit differs in capacitance at each of the toner concentration sensors installed on the multiple developing units.

10 Claims, 7 Drawing Sheets

DEVELOPING DEVICE, IMAGE FORMING APPARATUS AND TONER CONCENTRATION DETECTING METHOD USING LC OSCILLATOR CIRCUIT

INCORPORATION BY REFERENCE

This application claims priority to Japanese Patent Application No. 2013-196046 filed on Sep. 20, 2013, and Japanese Patent Application No. 2013-196047 filed on Sep. 20, 2013, the entire disclosures of which are incorporated herein by reference.

BACKGROUND

This disclosure relates to a developing device, an image forming apparatus having the same, and a toner concentration detecting method, and particularly to a technique for detecting a toner concentration of a developer contained in a developing device.

As a device for detecting a toner concentration of a developer contained in a developing device, a toner concentration sensor having an LC oscillator circuit is known. Such a toner concentration sensor treats a change in permeability changed by the toner concentration of the developer as a change in an oscillating frequency of the LC oscillator circuit, thereby detecting the toner concentration of the developer. In recent years, for the purpose of miniaturization or cost reduction, a toner concentration sensor using a planar coil for a coil constituting the LC oscillator circuit has also been released.

Here, in an image forming apparatus that conducts color printing, the toner concentration sensor needs to be installed for the developer of each of magenta, cyan, yellow, and black. When the planar coil is used for the coil constituting the LC oscillator circuit, the oscillating frequency of each toner concentration sensor becomes a high frequency of several MHz, and thus radiation noise is increased. For this reason, the radiation noise radiated from the multiple toner concentration sensors adds up, and the radiation noise radiated from the entire apparatus may be further increased.

With respect to the above problem, in the image forming apparatus having the multiple toner concentration sensors, a technique for suppressing the radiation noise radiated from the entire apparatus by controlling a switching operation of power and shifting timing to supply the power to each toner concentration sensor is known (Technique A). Further, a technique for providing an earth plate on a rear surface of a board for the toner concentration sensor and causing the earth plate to magnetically shield the radiation noise is known (Technique B).

SUMMARY

As an aspect of this disclosure, a technique further improving the aforementioned technique is proposed.

A developing device according to an aspect of this disclosure includes multiple developing units, and multiple toner concentration sensors.

The multiple developing units contain respective developers.

The multiple toner concentration sensors have respective LC oscillator circuits and are disposed at the respective multiple developing units.

Thus, a capacitor constituting the LC oscillator circuit differs in capacitance at each of the toner concentration sensors installed on the multiple developing units.

Further, a developing device according to another aspect of this disclosure includes multiple developing units, and multiple toner concentration sensors.

The multiple developing units contain respective developers.

The multiple toner concentration sensors have respective LC oscillator circuits and are disposed at the respective multiple developing units.

Thus, a distance between a coil constituting the LC oscillator circuit and the developer to be detected differs at each of the toner concentration sensors installed on the multiple developing units.

Further, an image forming apparatus according to another aspect of this disclosure includes the aforementioned developing device and an image forming unit configured to form a toner image on recording paper using toner supplied from the developing device.

Further, a toner concentration detecting method according to another aspect of this disclosure detects toner concentrations of developers contained in multiple developing units using multiple signals having different oscillating frequencies output from multiple toner concentration sensors, wherein the multiple toner concentration sensors have LC oscillator circuits installed on the respective multiple developing units in which the developers intended for the toner concentration detection are contained, and differ in either capacitance of a capacitor constituting the LC oscillator circuit or inductance of a coil which is determined by a distance between the coil constituting the LC oscillator circuit and the developer.

DETAILED DESCRIPTION

Hereinafter, a developing device and an image forming apparatus having the same according to an embodiment of this disclosure will be described with reference to the drawings.

First Embodiment

Figure 1:
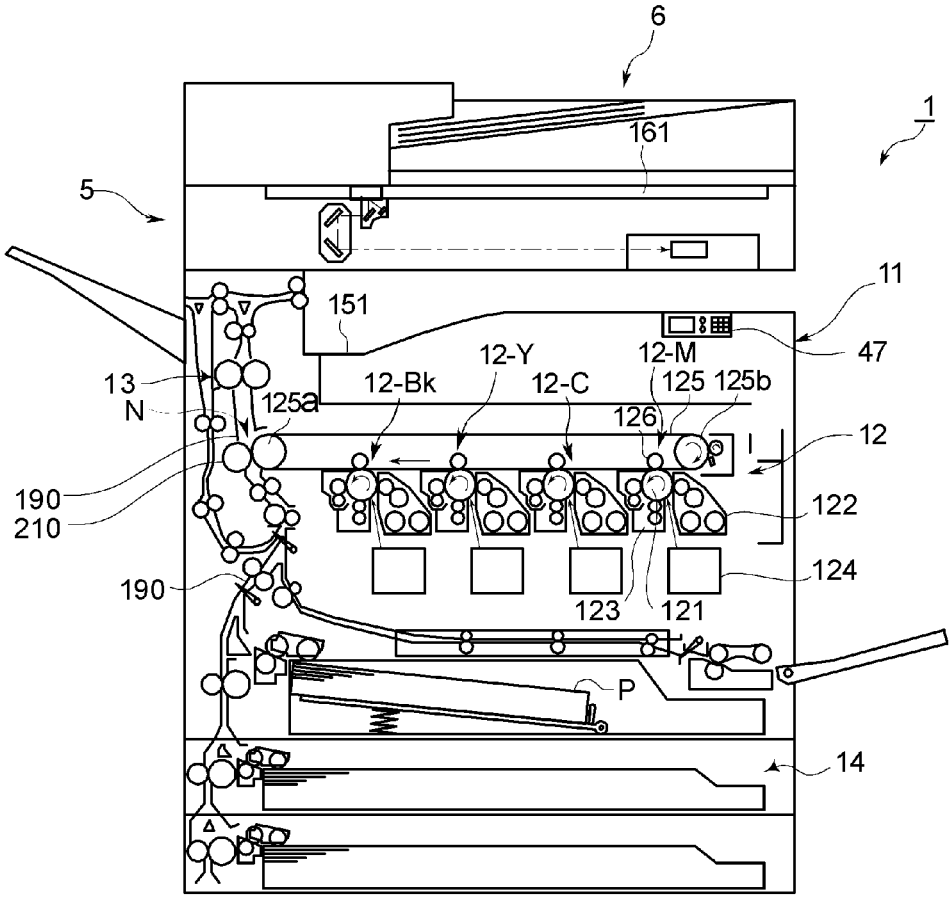
FIG. 1 is a front cross-sectional view illustrating a structure of an image forming apparatus having a developing device according to a first embodiment of this disclosure.

FIG. 1 is a front cross-sectional view illustrating a structure of an image forming apparatus having a developing device according to a first embodiment of this disclosure.

An image forming apparatus 1 according to a first embodiment of this disclosure is, for instance, a multifunction peripheral combining multiple functions such as a copy function, a printer function, a scanner function, and a facsimile function. The image forming apparatus 1 includes an apparatus main body 11 equipped with an operation unit 47, an image forming unit 12, a fixing unit 13, a paper feed unit 14, a document feed unit 6, and a document scanning unit 5.

When the image forming apparatus 1 performs a document scanning operation, the document scanning unit 5 optically scans an image of a document fed by the document feed unit 6 or an image of a document placed on a document table glass 161, generating image data. The image data generated by the document scanning unit 5 is stored in an internal hard disk drive (HDD) or a networked computer.

When the image forming apparatus 1 performs an image forming operation, the image forming unit 12 forms toner images on recording paper P acting as a recording medium fed from the paper feed unit 14 based on the image data generated by the document scanning operation or the image data stored in the internal HDD.

The image forming units 12 includes an image forming unit 12-M for forming an image having the color magenta (M), an image forming unit 12-C for forming an image having the color cyan (C), an image forming unit 12-Y for forming an image having the color yellow (Y), and an image forming unit 12-Bk for forming an image having the color black (Bk). The image forming units 12-M, 12-C, 12-Y, and 12-Bk are each equipped with a photosensitive drum 121, a charging device 123, an exposing device 124, a developing unit 122, and a primary transfer roller 126.

Among the above components, the photosensitive drum 121, the charging device 123, the exposing device 124, and the primary transfer roller 126 are common to the image forming units 12-M, 12-C, 12-Y, and 12-Bk. Some constitution of the developing unit 122 differs among the image forming units 12-M, 12-C, 12-Y, and 12-Bk. Hereinafter, when the developing unit 122 and components constituting the developing unit 122 are described as distinguished between the image forming units, they are distinguished by adding "-M," "-C," etc. to ends of reference numbers thereof.

The image forming apparatus 1 according to the present embodiment uses a two-component developer composed of toner and a carrier, and the two-component developer (may be hereinafter referred to as simply a "developer") is contained in the developing unit 122 of each of the image forming units 12-M, 12-C, 12-Y, and 12-Bk. The developing unit 122 supplies the toner contained in the developer to a surface of the photosensitive drum 121 that has been charged by the charging device 123 and exposed by the exposing device 124.

When color printing is performed, the image forming units 12-M, 12-C, 12-Y, and 12-Bk of the image forming unit 12 cause the toner images to be formed on the photosensitive drums 121 by charging, exposing, and developing processes based on images composed of respective color components constituting the image data, and cause the toner images to be transferred to an intermediate transfer belt 125 stretched on a driving roller 125*a* and a driven roller 125*b* by the primary transfer rollers 126.

The intermediate transfer belt 125 has image carrying surfaces to which the toner images are transferred and which are set for an outer circumferential surface thereof, and is driven by the driving roller 125*a* in contact with circumferential surfaces of the photosensitive drums 121. The intermediate transfer belt 125 endlessly travels between the driving roller 125*a* and the driven roller 125*b* while being synchronized with each photosensitive drum 121.

The toner images of the respective hues which are transferred onto the intermediate transfer belt 125 are superposed on the intermediate transfer belt 125 by adjusting transfer timings, and become a color toner image. A secondary transfer roller 210 causes the color toner image formed on the surface of the intermediate transfer belt 125 to be transferred to the recording paper P, which is conveyed from the paper feed unit 14 along a conveying path 190, at a nip zone N across the intermediate transfer belt 125 between the secondary transfer roller 210 and the driving roller 125*a*. Afterwards, the fixing unit 13 causes the toner image on the recording paper P to be fixed to the recording paper P by thermocompression. The recording paper P on which the color image going through the fixing process is formed is ejected to an eject tray 151.

Figure 2:
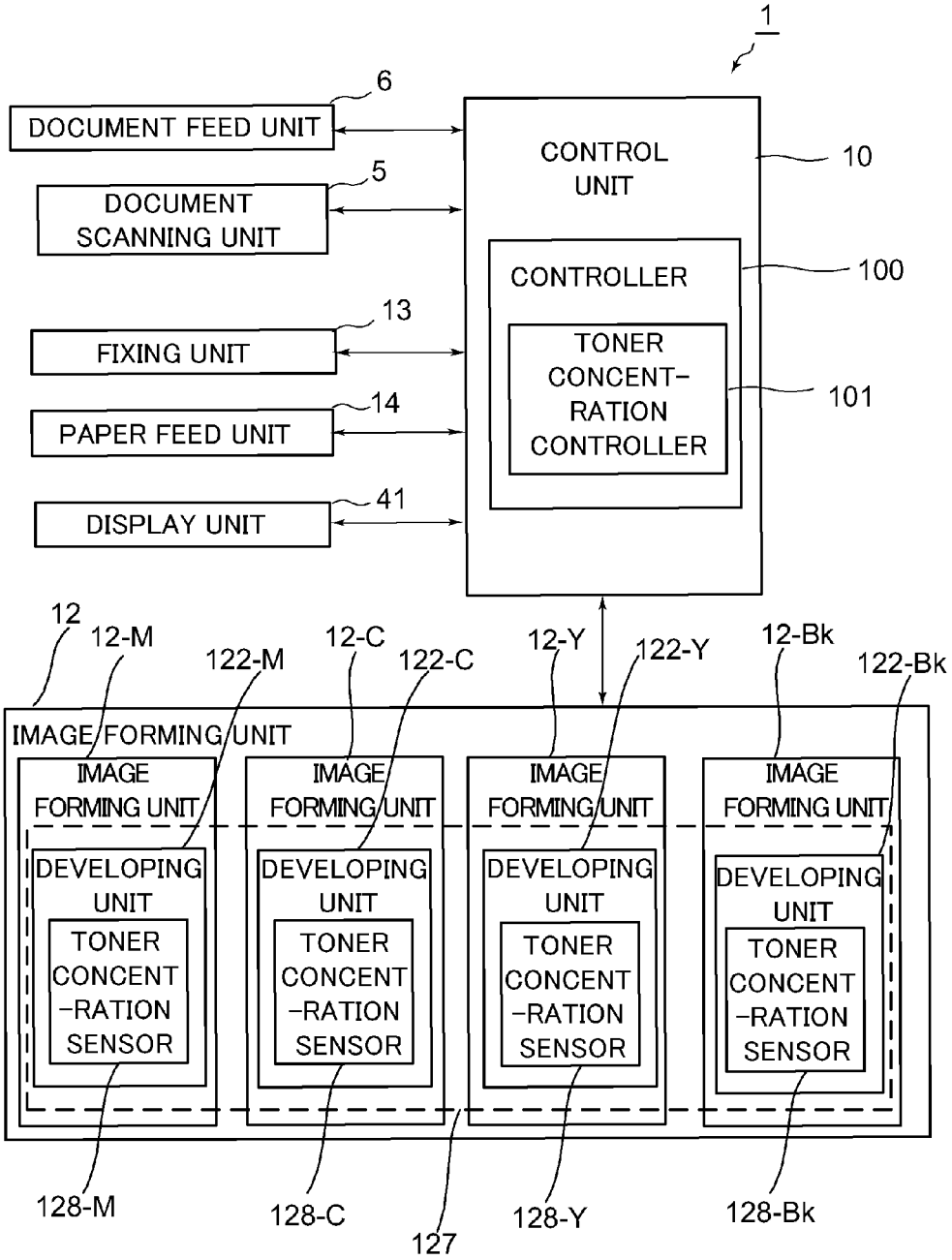
FIG. 2 is a block diagram schematically illustrating primary internal constitutions of the image forming apparatus according to the first embodiment of this disclosure.

Next, an internal constitution of the image forming apparatus 1 will be described. FIG. 2 is a block diagram schematically illustrating primary internal constitutions of the image forming apparatus 1.

The image forming apparatus 1 includes a control unit 10, a document scanning unit 5, a document feed unit 6, an image forming unit 12, a fixing unit 13, and a paper feed unit 14.

The control unit 10 takes charge of controlling overall operations of the image forming apparatus 1 made up of a central processing unit (CPU), a random access memory (RAM), a read only memory (ROM), and a dedicated hardware circuit. The control unit 10 includes a controller 100. The controller 100 is connected to the document scanning unit 5, the document feed unit 6, the image forming unit 12, the fixing unit 13, and the paper feed unit 14, and controls driving of each unit.

A developing device 127 is made up of a developing unit 122-M for magenta, a developing unit 122-C for cyan, a developing unit 122-Y for yellow, and a developing unit 122-Bk for black.

Further, a toner concentration sensor 128-M is installed on the developing unit 122-M of the image forming unit 12-M for magenta, and detects a toner concentration of a magenta developer. A toner concentration sensor 128-C is installed on the developing unit 122-C of the image forming unit 12-C for cyan, and detects a toner concentration of a cyan developer. A toner concentration sensor 128-Y is installed on the developing unit 122-Y of the image forming unit 12-Y of yellow, and detects a toner concentration of a yellow developer. A toner concentration sensor 128-Bk is installed on the developing unit 122-Bk of the image forming unit 12-Bk for black, and detects a toner concentration of a black developer.

The controller 100 has a toner concentration controller 101. The toner concentration controller 101 is connected to each toner concentration sensor 128 of the image forming apparatus 1, and detects the toner concentrations of the developers of the respective colors from oscillating frequencies output from the toner concentration sensors 128-M, 128-C, 128-Y, and 128-Bk. Then, the toner concentration controller 101 controls the image forming apparatus 1 based on the detected toner concentrations of the developers of the respective colors. For example, the toner concentration controller 101 displays the indication to replenish the toner on a display unit 41 made up of a liquid crystal display (LCD) when any toner concentrations of the developers are equal to or lower than a predetermined concentration.

Figure 3:
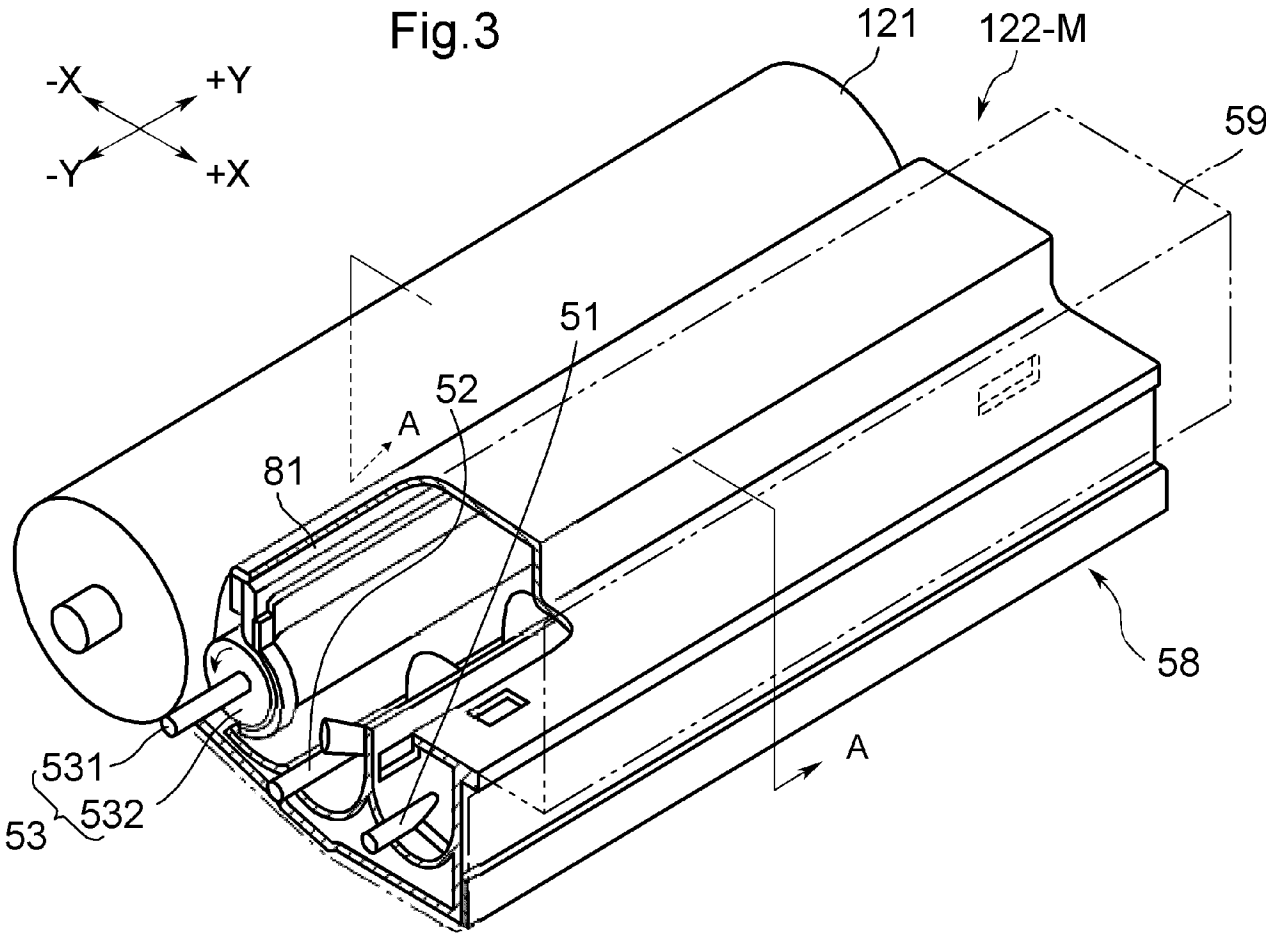
FIG. 3 is a perspective view illustrated by cutting away a part of a developing unit according to the first embodiment of this disclosure.
Figure 4:
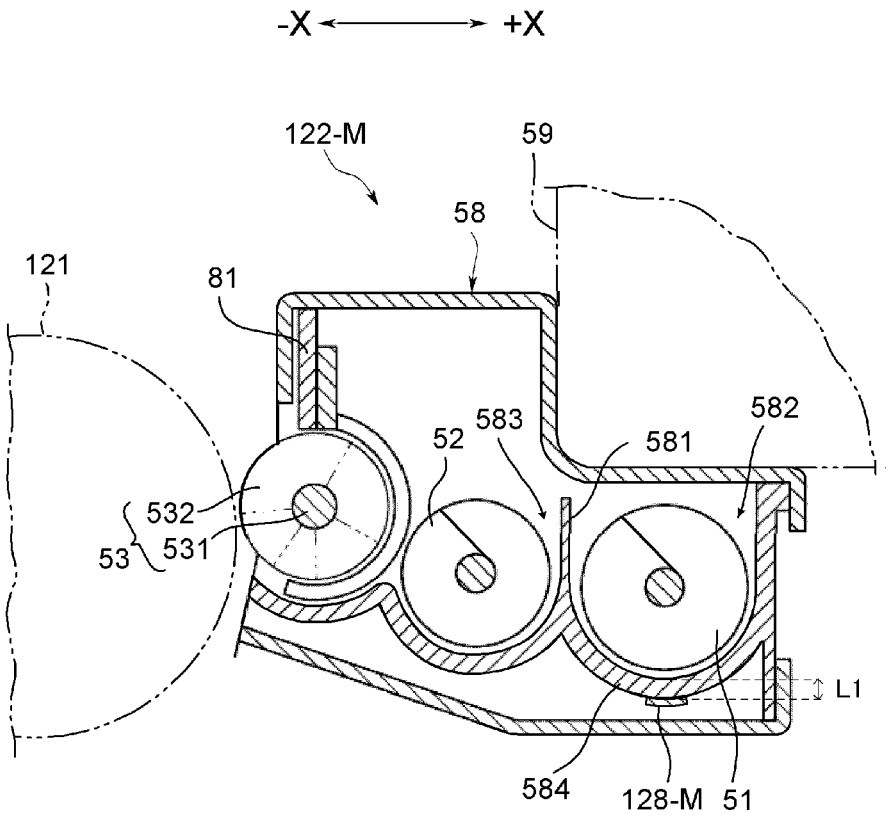
FIG. 4 is a cross-sectional view taken along line A-A of FIG. 3.

Next, a constitution of the developing device 127 will be described using FIGS. 3 and 4. In FIGS. 3 and 4, a constitution of the developing unit 122-M for magenta among the developing units 122 of the developing device 127 is illustrated.

FIG. 3 is a perspective view illustrated by cutting away a part of the developing unit 122-M. FIG. 4 is a cross-sectional view taken along line A-A of FIG. 3. In FIGS. 3 and 4, an X-X direction is referred to as a leftward/rightward direction, and a Y-Y direction is referred to as a frontward/rearward direction. Particularly, a −X direction is referred to as a left side, a +X direction as a right side, a −Y direction as a front side, and a +Y direction as a rear side. Here, the constitution of the developing unit 122-M for magenta is described. However, components in which "-M" is not added to ends of reference numbers thereof have the same constitution as the other developing units, i.e. the developing unit 122-C for cyan, the developing unit 122-Y for yellow, and the developing unit 122-Bk for black.

As illustrated in FIGS. 3 and 4, the developing unit 122-M is equipped with a first spiral feeder 51, a second spiral feeder 52, and a developing roller 53 in a casing 58.

The casing 58 serves as a container containing the developer. A partition 581 is formed in an interior of the casing 58. Thereby, the interior of the casing 58 is divided into a first chamber 582 in which the first spiral feeder 51 is disposed and a second chamber 583 in which the second spiral feeder 52 is disposed. The toner replenished from a toner container 59 to the first chamber 582 is agitated by the first spiral feeder 51, and is conveyed toward the second chamber 583. The toner conveyed to the second chamber 583 is conveyed toward the front side by the second spiral feeder 52.

The toner concentration sensor 128-M is mounted on an outer surface of the casing 58 at a lower portion of the first chamber 582. The toner concentration sensor 128-M is a so-called permeability detection type sensor having an LC oscillator circuit, and outputs a signal of the oscillating frequency corresponding to the toner concentration of the developer contained in the first chamber 582. As the toner concentration sensor 128-M is provided at the aforementioned position, it is possible to detect the toner concentration of the developer that flows back from the developing roller 53 before new toner is replenished from the toner container 59.

The developing roller 53 includes a magnet roller 531 and a developing sleeve 532. The developing sleeve 532 is sheathed on the magnet roller 531. The developing sleeve 532 is rotatably supported by the casing 58 at a position adjacent to the surface of the photosensitive drum 121 and the second spiral feeder 52.

The developer moving from the first and second spiral feeders 51 and 52 is carried on a circumferential surface of the developing sleeve 532 by a magnetic force of the magnet roller 531.

The toner in the developer attached to the developing roller 53 also flies to the photosensitive drum 121 due to a potential difference between a surface potential of the photosensitive drum 121 and a developing bias applied to the developing roller 53, and thus a toner image is formed on the surface of the photosensitive drum 121.

A regulating blade 81 regulates the developer carried on the circumferential surface of the developing sleeve 532 to a predetermined layer thickness, and is supported above the developing sleeve 532 by the casing 58 at a predetermined interval between the regulating blade 81 and the developing sleeve 532.

Figure 5:
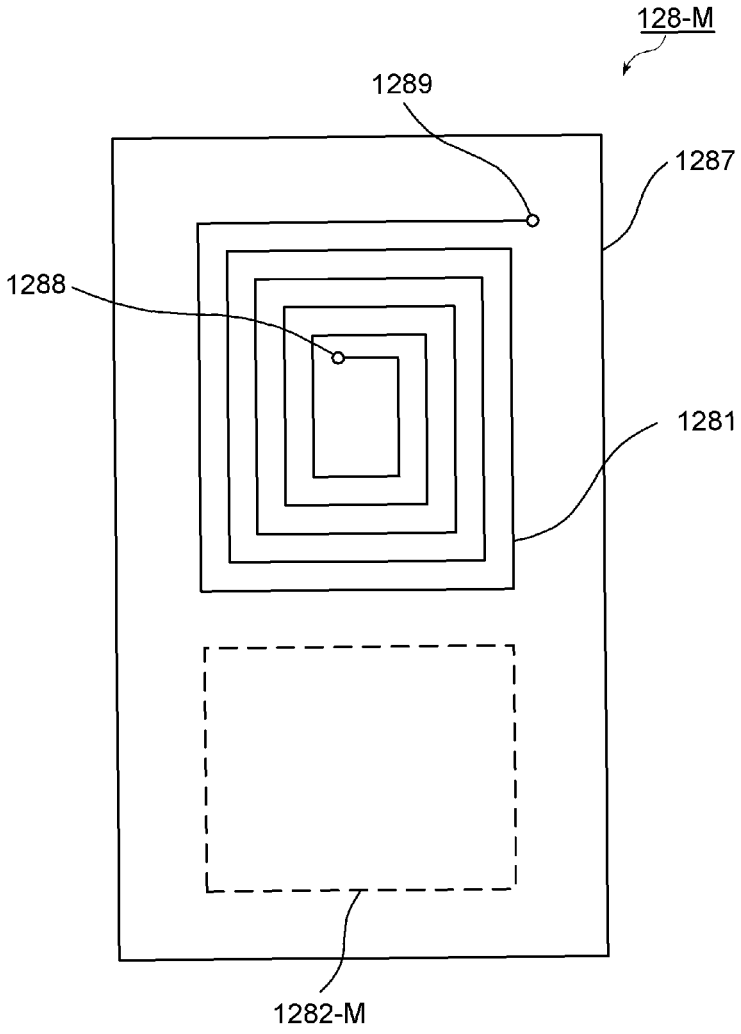
FIG. 5 is a plan view illustrating the configuration of a toner concentration sensor according to the first embodiment of this disclosure.
Figure 6:
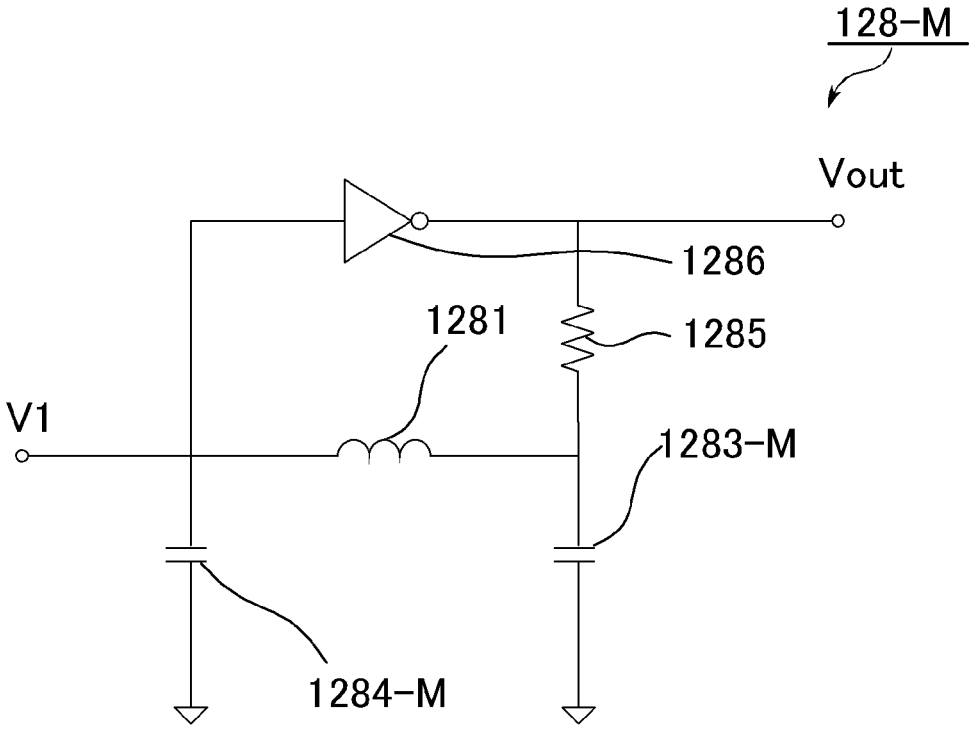
FIG. 6 is a view illustrating a circuit configuration of the toner concentration sensor according to the first embodiment of this disclosure.

Next, a constitution of the toner concentration sensor will be described using FIGS. 5 and 6. In FIGS. 5 and 6, a constitution of the toner concentration sensor 128-M for magenta is illustrated. However, components in which "-M" is not added to ends of reference numbers thereof have the same constitution as the other toner concentration sensors, i.e. the toner concentration sensor 128-C for cyan, the toner concentration sensor 128-Y for yellow, and the toner concentration sensor 128-Bk for black.

FIG. 5 is a plan view illustrating the configuration of the toner concentration sensor 128-M. As illustrated in FIG. 5, the toner concentration sensor 128-M has a planar coil 1281 formed on one surface of a rectangular board 1287. The board 1287 is a so-called flexible board, and has a shape that follows the outer surface of the casing 58 in a state in which the toner concentration sensor 128-M is mounted on the casing 58 (see FIG. 4).

The planar coil 1281 has a rectangular outline. The toner concentration sensor 128-M is disposed such that the surface on which the planar coil 1281 is formed becomes a side coming into contact with the outer surface of the casing 58.

Another circuit component 1282-M such as a capacitor constituting the LC oscillator circuit is mounted on the back of the surface on which the planar coil 1281 is formed. Connecting members 1288 and 1289 passing through the board 1287 are formed at ends of the planar coil 1281, and the planar coil 1281 and the other circuit component 1282-M are connected by the connecting members 1288 and 1289.

FIG. 6 is a view illustrating a circuit configuration of the toner concentration sensor 128-M. As illustrated in FIG. 6, the planar coil 1281 in the toner concentration sensor 128-M is connected to opposite ends of an inverter 1286. Further, capacitors 1283-M and 1284-M are connected between the planar coil 1281 and the ground. In addition, a resistor 1285 is connected between an output side of the inverter 1286 and one end of the planar coil 1281. The oscillating frequency f which the toner concentration sensor 128-M having this circuit configuration outputs is represented by the following formula.

$$f = \frac{1}{2\pi\sqrt{\frac{C_1 C_2}{C_1 + C_2} L}} \qquad \text{Formula 1}$$

In the formula above, L indicates the inductance of the planar coil 1281, $C_1$ indicates the capacitance of the capacitor 1283-M, and $C_2$ indicates the capacitance of the capacitor 1284-M. As shown in the formula above, the oscillating frequency f which the toner concentration sensor 128-M outputs is determined by the inductance L of the planar coil 1281, the capacitance $C_1$ of the capacitor 1283-M, and the capacitance $C_2$ of the capacitor 1284-M.

In the image forming apparatus 1 according to the present embodiment, the capacitance of the capacitor 1283 constituting the LC oscillator circuit differs at each of the toner concentration sensors 128 detecting the toner concentrations of the developers of the different colors. In the present embodiment, the capacitor 1283-M constituting the LC oscillator circuit of the toner concentration sensor 128-M, the capacitor 1283-C constituting the LC oscillator circuit of the toner concentration sensor 128-C, the capacitor 1283-Y constituting the LC oscillator circuit of the toner concentration sensor 128-Y, and the capacitor 1283-Bk constituting the LC oscillator circuit of the toner concentration sensor 128-Bk are different in capacitance.

In addition to the capacitance of the capacitor 1283, the capacitance of the capacitor 1284 may differ at each toner concentration sensor 128. Further, both the capacitors 1283 and 1284 may differ in capacitance at each toner concentration sensor 128.

Here, in the technique A described above, since the timing to supply the power to each toner concentration sensor is shifted, a detection time of the toner concentrations for the developers of the respective colors of magenta, cyan, yellow, and black is reduced. Thus, there is a problem that precision in detection of the toner concentration is lowered. Further, in the technique B described above, the earth plate is provided, and thereby no coil can be provided on the rear surface of the board. As such, there is a problem that precision in detection of the toner concentration is lowered.

In contrast, in the developing device 127 and the image forming apparatus 1 according to the present embodiment, at least one of the capacitor 1283 and the capacitor 1284 differs in capacitance at each toner concentration sensor 128, and thereby the oscillating frequency output from each toner concentration sensor 128 is made different at each toner concentration sensor 128. In other words, in the toner concentration detecting method according to the present embodiment, the toner concentrations of the developers contained in the multiple developing units 122 are detected using multiple signals having the different oscillating frequencies output from the multiple toner concentration sensors 128, wherein the multiple toner concentration sensors 128 have the LC oscillator circuits installed on the respective multiple developing units 122 in which the developers intended for the toner concentration detection are contained, and are configured such that at least one of the capacitor 1283 and the capacitor 1284 constituting the LC oscillator circuit differs in capacitance at each of the toner concentration sensors 128. For example, in the present embodiment, each of the output oscillating frequencies differs between not less than 1 kHz and not more than 10 kHz at each of the toner concentration sensors 128 detecting the toner concentrations of the different colors. In this way, even when the toner concentration sensors 128 are operated at the same time, it is possible to suppress radiation noise generated from the developing device 127 and the image forming apparatus 1.

Further, the toner concentration sensors 128 may use the same constitution, excluding the capacitor 1283 and/or the capacitor 1284 constituting the LC oscillator circuit. For this reason, it is possible to suppress manufacturing costs of the developing device 127 and the image forming apparatus 1.

Further, since the radiation noise generated from the developing device 127 and the image forming apparatus 1 can be suppressed, it is possible to reduce electromagnetic interference (EMI) countermeasure components such as a shield component provided for the image forming apparatus 1. Thus, it is possible to suppress the manufacturing costs of the developing device 127 and the image forming apparatus 1.

A variable capacitor whose capacitance is variable may be used for the capacitor 1283 and the capacitor 1284 constituting the LC oscillator circuit. Thereby, the same constitution can be used for all the circuit components and the board of each toner concentration sensor 128. As such, it is possible to further suppress the manufacturing costs of the developing device 127.

Second Embodiment

In the developing device 127 according to the first embodiment, at least one of the capacitor 1283 and the capacitor 1284 constituting the LC oscillator circuit differs in capacitance at each of the toner concentration sensors 128-M, 128-C, 128-Y, and 128-Bk. In contrast, in a developing device 127 according to the second embodiment, a capacitor 1283 and a capacitor 1284 constituting an LC oscillator circuit of each of toner concentration sensors 128-M, 128-C, 128-Y, and 128-Bk are identical in capacitance to each other. That is, each toner concentration sensor 128 is made up of the same circuit components and board.

Referring to FIG. 4, in the developing device 127 according to the second embodiment, a portion 584 of a casing 58 on which a toner concentration sensor 128-M is mounted has a thickness $L_1$ that differs from those of other developing units of the developing device 127, i.e. a developing unit 122-C for cyan, a developing unit 122-Y for yellow, and a developing unit 122-Bk for black. In detail, the thickness $L_1$ in the developing unit 122-M for magenta is about 1.0 mm, and the thicknesses of the casings in the other developing unit 122-C for cyan, developing unit 122-Y for yellow, and developing unit 122-Bk for black of the developing device 127 have lengths that gradually differ in units of about 0.1 mm with respect to the thickness $L_1$ in the developing unit 122-M for magenta.

For this reason, a distance between a planar coil 1281 constituting the LC oscillator circuit in the toner concentration sensor 128-M and a developer to be detected is different from those in the other toner concentration sensor 128-C for cyan, toner concentration sensor 128-Y for yellow, and toner concentration sensor 128-Bk for black of the developing device 127. As a result, inductance L of the planar coil 1281 constituting the LC oscillator circuit in the toner concentration sensor 128 differs at each toner concentration sensor.

As described previously, the oscillating frequency f which the toner concentration sensor 128 outputs is determined by the inductance L of the planar coil 1281, the capacitance $C_1$ of the capacitor 1283, and the capacitance $C_2$ of the capacitor 1284. In the image forming apparatus 1 according to the second embodiment, the distance between the planar coil 1281 and the developer to be detected differs at each toner concentration sensor 128, and thereby the oscillating frequency output from the toner concentration sensor 128 differs at each toner concentration sensor 128. In other words, in the toner concentration detecting method according to the second embodiment, the toner concentrations of the developers contained in the multiple developing units 122 are detected using the multiple signals having the different oscillating frequencies output from the multiple toner concentration sensors 128 which have the LC oscillator circuits installed on the respective multiple developing units 122 in which the developers intended for the toner concentration detection are contained and which differ in the inductance of the planar coil 1281 which is determined by the distance between the planar coil 1281 constituting the LC oscillator circuit and the developer. For example, in the second embodiment, each of the output oscillating frequencies differs between not less than 1 kHz and not more than 10 kHz at each of the toner concentration sensors 128 detecting the toner concentrations of the different colors. In this way, even when the toner concentration sensors 128 are operated at the same time, it is possible to suppress the radiation noise generated from the developing device 127 and the image forming apparatus 1.

Further, since the toner concentration sensors 128 are made up of the same circuit component and board, it is possible to suppress the manufacturing costs of the developing device 127 and the image forming apparatus 1.

The above description has been made of the example in which the casings 58 of the developing units 122 differ in thickness at each developing unit 122 at a position at which each toner concentration sensor 128 is arranged, and thereby the distance between the coil 1281 constituting the LC oscillator circuit and the developer to be detected differs at each toner concentration sensor 128 installed on each developing unit 122. However, this disclosure is not necessarily limited to this example.

Figure 7:
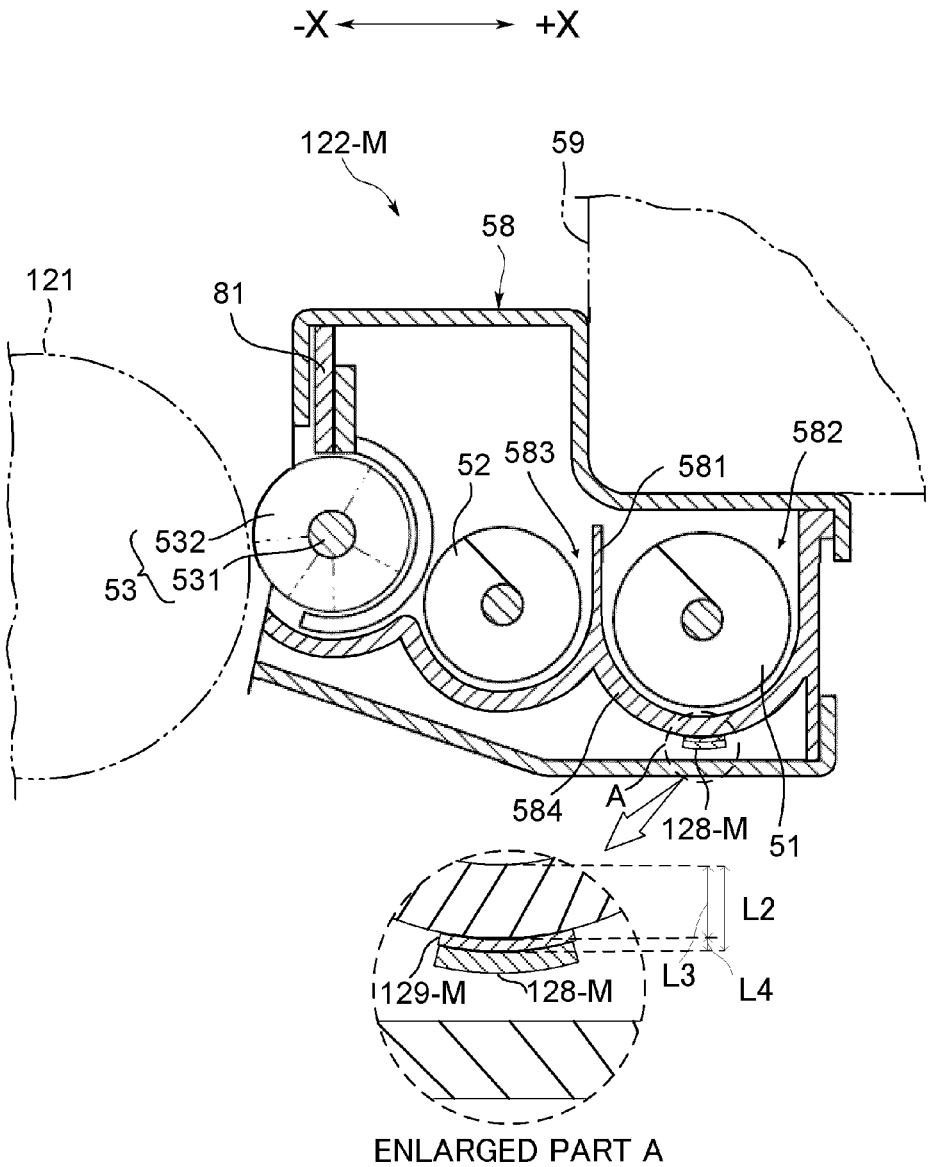
FIG. 7 is a cross-sectional view illustrating a constitution of a developing device according to a modification of a second embodiment of this disclosure.

FIG. 7 is a cross-sectional view illustrating a constitution of a developing device according to a modification of the second embodiment of this disclosure. In a developing unit 122-M according to a modification, a thickness $L_3$ of a portion 584 on which a toner concentration sensor 128-M is mounted is equal to those of other developing units, i.e. a developing unit 122-C for cyan, a developing unit 122-Y for yellow, and a developing unit 122-Bk for black.

The toner concentration sensor 128-M is disposed on an outer surface of the casing 58 via a dielectric member 129-M provided between the toner concentration sensor 128-M and the portion 584 of the casing 58 on which the toner concentration sensor 128-M is mounted. A thickness $L_4$ of the dielectric member 129-M is different from a thickness of the dielectric member in the other developing unit 122-C for cyan, developing unit 122-Y for yellow, or developing unit 122-Bk for black of the developing device 127. For this reason, a distance $L_2$ between a planar coil 1281 constituting an LC oscillator circuit at the toner concentration sensor 128-M and a developer to be detected is different from those at other toner concentration sensors of the developing device 127, i.e. a toner concentration sensor 128-C for cyan, a toner concentration sensor 128-Y for yellow, and a toner concentration sensor 128-Bk for black. Thus, even in the developing device 127 according to the modification, the same effects as illustrated in the aforementioned embodiment are obtained.

Further, in the developing device 127 according to the modification, since it is unnecessary to change the thickness of the portion of the casing 58 on which the toner concentration sensor 128 is mounted at each of the developers of the different colors, it is possible to suppress the manufacturing costs of the developing device 127 and the image forming apparatus 1.

This disclosure can be variously modified without being limited to the constitutions of the embodiments. The constitution illustrated in each embodiment using FIGS. 1 to 7 is merely one embodiment of this disclosure, and the constitution of this disclosure is not limited thereto.

For example, a shape of the coil constituting the LC oscillator circuit is not limited to a circle. That is, any spirally wound shape will do, and an outline of the coil may be, for instance, a rectangular shape.

Further, in the aforementioned embodiments, the example in which the coil is formed on one surface of the board of the toner concentration sensor has been described. However, this disclosure is not necessarily limited to this example. The coil may be formed on both surfaces of the board. By doing this, detection performance of the toner concentration of the toner concentration sensor can be improved.

Further, in the aforementioned embodiments, the image forming apparatus for forming the image using the two-component developer composed of the toner and the carrier has been described. However, this disclosure is not necessarily limited to this example. Even in an image forming apparatus for forming an image using a so-called monocomponent developer, the toner concentration can be detected by using the permeability detection type toner concentration sensor described in the aforementioned embodiments.

Further, in the aforementioned embodiments, the example in which the multiple developing units contain the developers of the different colors has been described. However, this disclosure is not necessarily limited to this example. This disclosure may detect the toner concentrations of the developers contained in the multiple developing units. For example, the developers of the same color may be contained in the multiple developing units.

The circuit configuration of the toner concentration sensor illustrated in FIG. 6 is one example, and this disclosure is not necessarily limited to this example.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A developing device comprising:

multiple developing units configured to contain developers; and multiple toner concentration sensors each including an LC oscillator circuit, and respectively provided for the multiple developing units, wherein the LC oscillator circuit includes a fixed capacitor having a fixed capacitance, the capacitance of the fixed capacitor being different in each of the toner concentration sensors provided for the multiple developing units.

2. The developing device according to claim 1, wherein a coil constituting the LC oscillator circuit is a planar coil.

3. An image forming apparatus comprising:

the developing device according to claim 1; and an image forming unit configured to form a toner image on recording paper using toner supplied from the developing device.

4. The developing device according to claim 1, wherein the capacitor includes a first capacitor interposed between an end of a coil in the LC oscillator circuit and a ground, and a second capacitor interposed between the other end of the coil and the ground, and a capacitance of at least one of the first capacitor and the second capacitor is different in each of the toner concentration sensors.

5. A developing device comprising:

multiple developing units configured to contain developers; and multiple toner concentration sensors each including an LC oscillator circuit, and respectively provided for the multiple developing units, wherein the LC oscillator circuit includes a fixed coil having a fixed inductance, and a distance between the coil and the developer to be detected differs in each of the toner concentration sensors provided for the multiple developing units.

6. The developing device according to claim 5, wherein:

the toner concentration sensors are disposed in contact with outer surfaces of the developing units; and casings of the developing units differ in thickness at each developing unit at positions at which the toner concentration sensors are installed.

7. The developing device according to claim 5, wherein:

the toner concentration sensors are disposed on outer surfaces of the developing units via dielectric members, which are provided between the toner concentration sensors and the developing units; and the dielectric members differ in thickness at each of the toner concentration sensors installed on the multiple developing units.

8. The developing device according to claim 5, wherein the coil constituting the LC oscillator circuit is a planar coil.

9. An image forming apparatus comprising:

the developing device according to claim 5; and an image forming unit configured to form a toner image on recording paper using toner supplied from the developing device.

10. A toner concentration detecting method comprising detecting toner concentration of a developer stored in each of multiple developing units, on a basis of multiple signals of different oscillating frequencies respectively outputted from multiple toner concentration sensors, wherein the toner concentration sensors each include an LC oscillator circuit and are respectively provided for the multiple developing units each containing the developer the toner concentration of which is to be detected, the LC oscillator circuit includes at least one of a fixed capacitor having a fixed capacitance and a fixed coil having a fixed inductance, and at least one of the capacitance of the fixed capacitor in the LC oscillator circuit, and the inductance of the fixed coil determined based on a distance between the coil in the LC oscillator circuit and the developer, is different in each of the toner concentration sensors.

* * * * *